US006419209B1

(12) United States Patent
Shepherd

(10) Patent No.: US 6,419,209 B1
(45) Date of Patent: Jul. 16, 2002

(54) RAILING ASSEMBLY

(76) Inventor: John D. Shepherd, 13822 Bruns Rd., Manhattan, IL (US) 60442

( * ) Notice: Subject to any disclaimer, the term of this patent is extended or adjusted under 35 U.S.C. 154(b) by 0 days.

(21) Appl. No.: 09/538,826

(22) Filed: Mar. 30, 2000

(51) Int. Cl.[7] ..... E04H 17/16

(52) U.S. Cl. ..... 256/24; 256/65; 52/204.597; 52/204.591; 52/738.1

(58) Field of Search ..... 256/24, 65; 52/204.597, 52/738.1, 204.591

(56) References Cited

U.S. PATENT DOCUMENTS

RE28,643 E 12/1975 Blum

OTHER PUBLICATIONS

Blumcraft of Pittsburgh M–98 Railing Catalogue, 1997, pp 7 & 9–13.

*Primary Examiner*—Lynne H. Browne
*Assistant Examiner*—Ernesto Garcia
(74) *Attorney, Agent, or Firm*—Philip M. Kolehmainen

(57) ABSTRACT

A structural glass panel railing includes glass panels supported on a floor by a base assembly including a railing support assembly. the railing support assembly includes a shoe fastened t the floor, a base member locked to the shoe by a cam lock lever and a wedge member having a pocket receiving the panel. The wedge member is received in a channel of the base member and is held by a wedge action. A handrail assembly includes a handrail wedge member receiving the top edge of the panel. The handrail wedge member is received in a channel in a rail.

5 Claims, 2 Drawing Sheets

18

RAILING ASSEMBLY

FIELD OF THE INVENTION

The present invention relates to railings, and more particularly to an improved railing assembly in which a panel such as a glass panel is mounted vertically above a floor support surface by a base assembly.

DESCRIPTION OF THE PRIOR ART

A structural glass rail system includes a series of vertical glass panels with bottom edges that are secured to a floor surface by a base support assembly. The top edges of the glass panels may support a top rail or handrail. The transparent or translucent glass panels provide an attractive appearance that is desirable to architects and designers as well as owners and users of commercial spaces and homes. However the appeal of structural glass rail systems has been limited by the difficulty and cost of installing known systems and the costs and inconvenience of repairing a damaged or marred glass panel after the initial installation. There is a long-standing but unfilled need for a structural glass panel rail system that is easy to install, relatively inexpensive, attractive and easy to repair.

In a typical known structural glass panel system cement is used to hold the glass panels in place. A receiving shoe is secured to a floor directly or by means of a support angle bracket. The shoe includes a pocket for receiving the bottom edge of a glass panel. After the shoe is in place, the groove is sealed and a glass panel is placed into the pocket, often on top of rubber spacers that hold the panel above fasteners or sharp edges that could cause breakage. Other spacers and/or wedges are used at the sides to center the panel in the groove and to hold it in a vertical position. A quick setting cement is poured into the groove in the shoe in a two step process. After cement partly fills the groove and sets, the wedges or spacers are removed, and the filling of the groove is completed in a second step. A cover or caulking is used to cover the cement and provide an acceptable appearance. The installation requires much skilled labor and time. Leakage and spillage of wet cement is a problem because it is difficult to completely seal the groove. Stairs and inclines add to these problems. In order to replace a panel, it must be broken out and the remaining edge and cement must be extracted with tools.

In order to overcome the many difficulties of poured concrete systems, two part mechanical bracketing systems have been proposed. U.S. patent RE 28,643 discloses a railing system including a structural receiving member that is fastened to a floor or is received in a formed slot in the floor. A mounting bracket having a channel is connected by fasteners to the receiving member. The edge of a glass panel is secured in the channel by an adhesive. The structural integrity of this rail system depends on the adhesion of the panel in the bracket groove and upon the attachment of the mounting bracket to the receiving member. Because the attachment of the panel to the bracket is very critical, this assembly is not done on site, and the panel is typically pre-bonded to the bracket in a factory operation. This adds to the expense and limits flexibility of design. Because the attachment of the bracket to the receiving member must be strong and secure, a large number of fasteners are required to hold the mounting bracket on the receiving member. This adds to the expense and increases the complexity and time required for installation.

SUMMARY OF THE INVENTION

A principal object of the present invention is to provide an improved railing system of the type including structural flat panels such as glass panels. Other objects are to provide a railing system that can be installed quickly and without special tools; to provide a railing system that can be assembled on site without the necessity for factory pre-assembly operations; to provide a railing assembly that does not require concrete and does not require fasteners for holding parts of the assembly together; to provide a railing assembly that is attractive in appearance and that is not expensive to make or install; and to provide a railing assembly that overcomes disadvantages of known railing systems.

In brief, in accordance with the invention there is provided a railing system including a railing support assembly for mounting a vertical glass panel above a floor surface. The panel has a peripheral edge and opposed planar side faces. The railing system includes an elongated base with an elongated support channel defined in the base. The base includes a pair of side walls and an end wall defining a generally U-shaped cross section of the channel. The channel has an open mouth. A wedge member is adapted to be mounted at a bottom edge of the panel. The wedge member has a base portion flanked by a pair of leg portions spaced apart by a distance generally equal to the thickness of the panel. The channel and the wedge member have mating tapered shapes with the open mouth of the channel being the widest part of the tapered shape of the channel and with the base portion of the wedge member being the narrowest part of the tapered shape of the wedge member.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
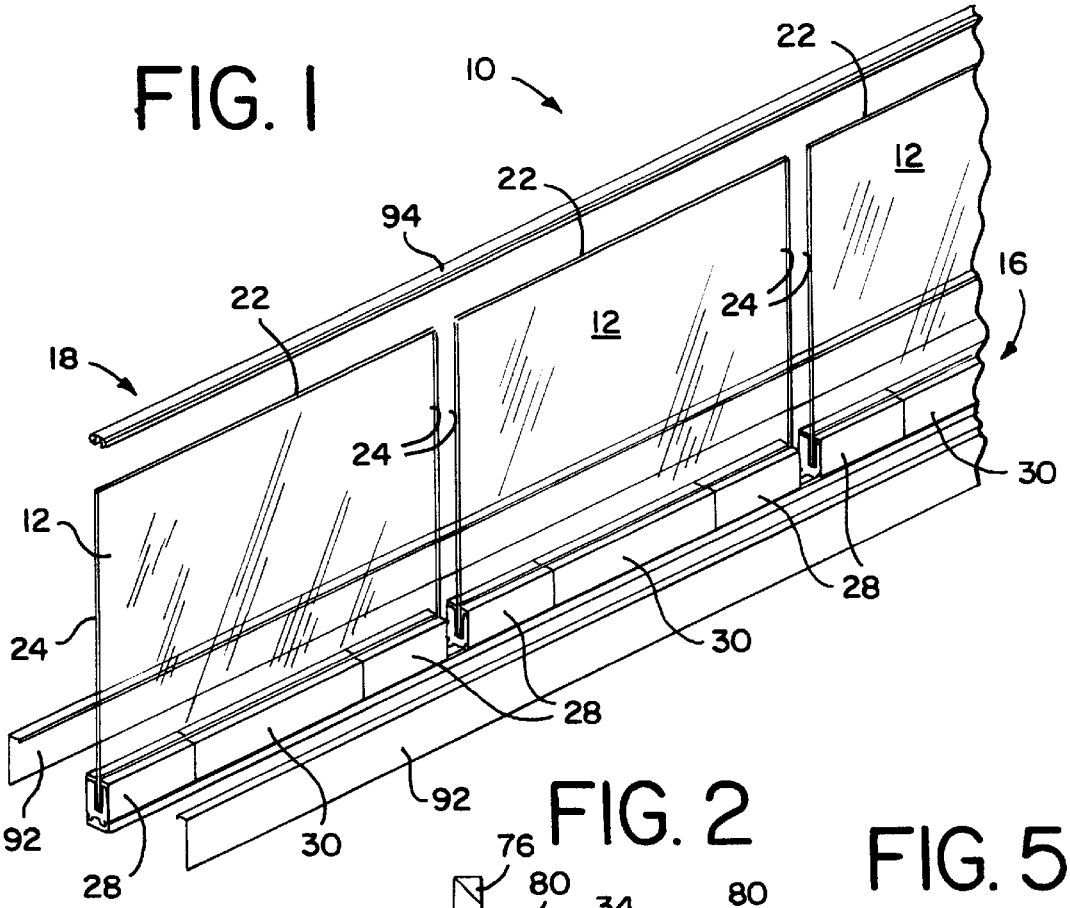
FIG. 1 is an isometric view, partly exploded, of a railing assembly constructed in accordance with the present invention.

Having reference now to the drawings, FIG. 1 is an illustration of a railing assembly designated as a whole by the reference character 10 and constructed n accordance with the present invention. In general, the railing assembly 10 includes a series of structural glass panels 12 supported in a vertical orientation above a horizontal floor 14 (FIGS. 6 and 7) by a base mounting assembly 16. A handrail assembly 18 is supported by the panels 12. The present invention is especially suited to railing assemblies having glass panels 12. However the principles of the invention are applicable to other similar flat panels such as metal or plastic or lattice panels and the like. Similarly, although the invention is described in connection with the horizontal floor 14, a railing assembly of the present invention can be installed over an inclined surface, for example at or near a ramp or stairway.

The glass panels 12 have a peripheral edge including a bottom edge 20, a top edge 22 and side edges 24. The panels 12 also have opposed, parallel, flat surfaces or faces 26. The panels 12 can be uniform in length and height, or if desired can have various sizes to accommodate installation requirements and design themes. One advantage of the present invention is that it permits great flexibility in design and placement of the railing assembly.

The base assembly 16 in the illustrated railing assembly 10 includes a plurality of railing support assemblies 28. Two assemblies 28 are used to support each panel 12, and these are located at opposite ends of the bottom edge 20 of each panel 12. Between each pair of assemblies 28 there is provided a spacer 30 so that the base assembly 16 has a uniform sectional shape.

Figure 2:
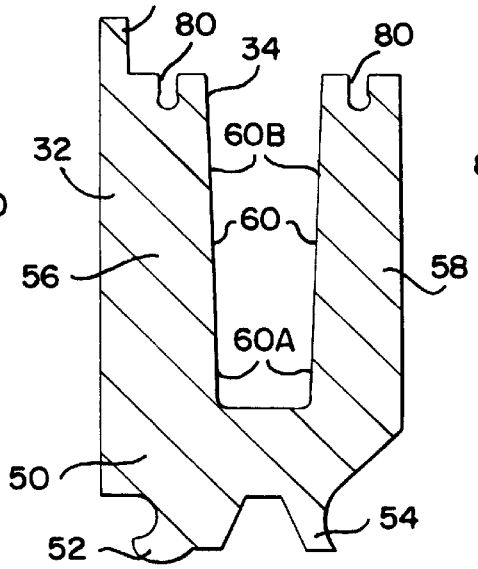
FIG. 2 is a vertical sectional view, on an enlarged scale, of the base member of the railing assembly.
Figure 5:
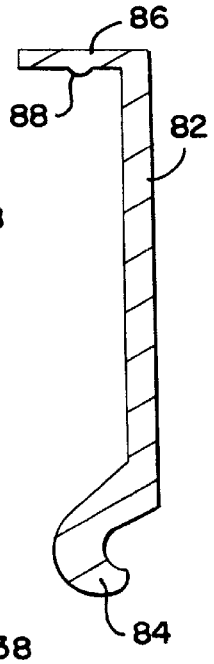
FIG. 5 is a vertical sectional view of the cam lock of the railing assembly.
Figure 4:
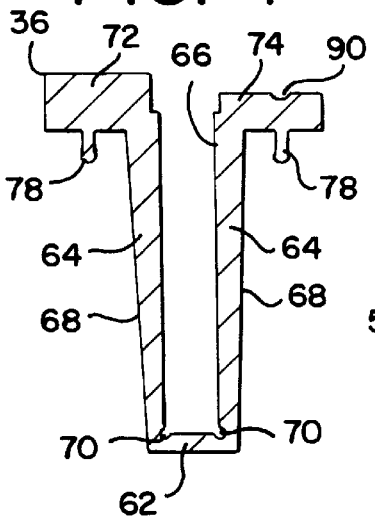
FIG. 4 is a vertical sectional view of the wedge member of the railing assembly.

Each railing support assembly 28 includes an elongated base member 32 (FIG. 2) having a channel 34 formed throughout its length, together with an elongated wedge member 36 (FIG. 4) that receives the bottom edge 20 of the panel 12. In accordance with the invention, the wedge member 36 is inserted into the channel 34 to secure, position and support the panel 12 without the need for concrete or adhesives or fasteners for interconnecting the panel 12, the wedge member 36 and the base member 32.

Figure 3:
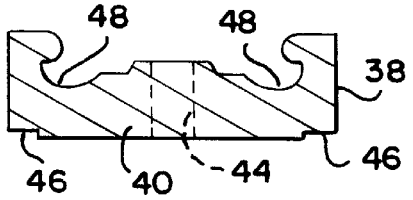
FIG. 3 is a vertical sectional view of the shoe of the railing assembly.

A shoe 38 (FIG. 3) supports the base member 32 and provides for securing the base assembly 16 to the floor 14. The shoe 38 includes a bottom wall 40 that is held against the surface of floor 14 by fasteners 42 (FIGS. 6 and 7) that extend through holes 44 in the shoe 38 and may, for example, be threaded into anchors embedded in the floor 14. If desired for a more secure attachment, mounting brackets may also be used. A pair of trim receiving grooves 46 are provided at the sides of the bottom wall 40. A pair of elongated sockets 48 extend along the length of the shoe 38. The shoe 38 has a uniform cross section throughout its length, and preferably is an extruded aluminum part.

Figure 6:
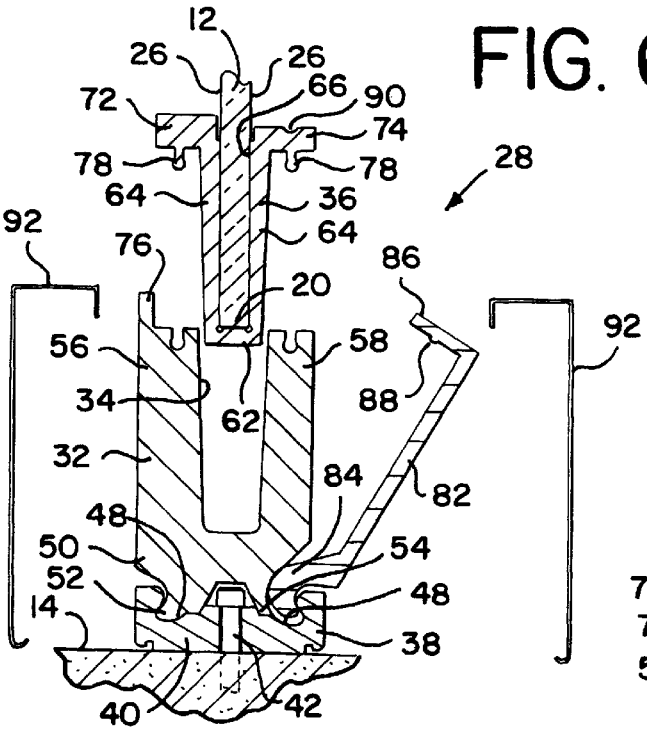
FIG. 6 is a vertical sectional view of the of the base assembly of the railing assembly showing the components during installation of the railing assembly.
Figure 7:
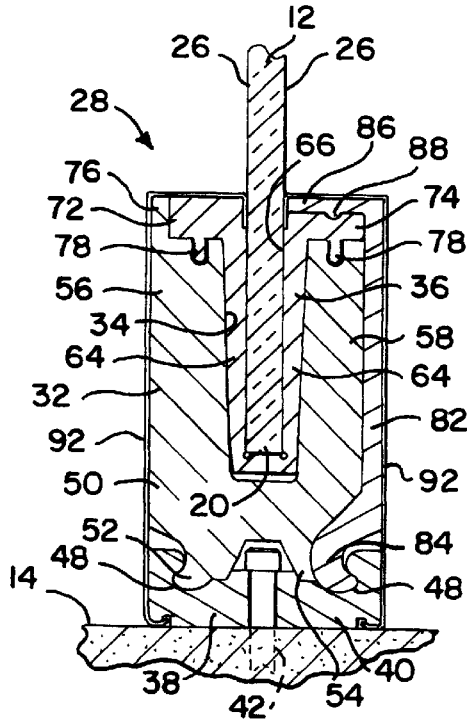
FIG. 7 is a view like FIG. 6 showing the installed base assembly of the railing assembly.

The base member 32 includes a lower body portion 50 with a downwardly extending full locking projection or foot 52 at one side and a partial locking projection or foot 54 at the other side. With the base member 32 tilted or inclined around its longitudinal axis, the full foot 52 can be inserted into one of the sockets 48, and when the base member 32 is returned to is vertical position, the partial foot 54 drops into the other socket 48 as seen in FIG. 6. A pair of side walls 56 and 58 extend upward from the lower body portion 50, one at each side of the channel 34. The side walls 56 and 58 have parallel outer surfaces and interfacing inner wall surfaces 60 that define the sides of the channel 34. Lower portions 60A of these surfaces are parallel to one another, and upper portions 60B are slightly inclined so that the mouth of the channel 34 is slightly wider than the base of the channel 34. For example, the parallel portions may be about one-fourth of the total height of the surfaces 60. The base member 32 has a uniform cross section throughout its length, and preferably is an extruded aluminum part.

Wedge member 36 includes a base portion 62 flanked by a pair of leg portions 64 defining a pocket 66 having a uniform width that is substantially equal to or preferably slightly larger than the thickness of the panel 12 so that the panel 12 can be received into the pocket 66 without excessive resistance. The leg portions 64 have outer surfaces 68 that are slightly inclined or wedge shaped, with a minimum thickness at the base portion 62. The intersections of the base portion 62 and the leg portions 64 are provided with relieved areas 70 permitting the leg portions 64 to flex relative to the base portion 62. The wedge member 36 has a uniform cross section throughout its length, and preferably is an extruded aluminum part.

To assemble the base mounting assembly 16, the shoe 38 is attached by fasteners 42 to the floor 14. The base member 32 is connected to the shoe 38, with the full foot 52 and the partial foot received in the sockets 48. The wedge member 36 is placed onto the panel 12, with the bottom edge 20 of the panel adjacent to the base portion 62 and with the leg portions 64 overlying the panel faces 26. A spacer film can be present between the leg portions 64 and the panel 12 if desired.

The wedge member 36 with panel 12 assembled to it is then inserted into the channel 34 in the base member 32. The narrowest part of the wedge member 36 is received into the widest part of the channel 34, and initially there is clearance between the wall surfaces 60 of the channel 34 and the surfaces 68 of the wedge member 36. As the wedge member 36 descends and approaches it final, lowermost position, the inclined surfaces 60B come into contact with the mating, similarly inclined surfaces 68. Surfaces 60B and 68 extend for most of the height of the pocket 66, and are inclined at only a small angle from vertical. In the final part of the relative movement, the inter-surface contact causes the leg portions 64 to flex or pivot slightly toward one another, tightly clamping the panel 12 in the assembly. The installer may need to tap the panel downward to achieve full insertion.

Wedge member 36 has a pair of upper flange portions 72 and 74 that lie on top of the base member 32. Flange portion 72 is thicker than flange portion 74 and is received next to an upward extension 76 of the base member 32. The inserted wedge member 36 is tightly held by a wedge action in the channel 34 of the base member 32. In the illustrated embodiment of the invention, this attachment is augmented by receipt of retention fingers or ribs 78 on flanges 72 and 74 into grooves 80 in the base member 32.

When the wedge member 36 is seated in the base member 32, the base member is locked to the shoe 38 by a cam lock lever 82. Lever 82 has a lower cam portion 84 that is received in one of the sockets 48 next to the partial foot 54 of the base member 32. When the lever 82 is pivoted up to its final position (FIG. 7) it traps the partial foot 54 in the socket 48 and locks the base member 32 onto the shoe 38. The lever 82 includes an upper flange 86 that overlies the thinner flange portion 74. The flange 86 and the top surface of the base member 32 have mating detent protrusions 88 and recesses 90 to retain the lever 82 in position. The cam lock lever 82 has a uniform cross section and may be an extruded aluminum part. Trim pieces 92 may be attached to opposite sides of the railing support assemblies 28 to provide a desired appearance.

In the illustrated embodiment of the invention, each railing support assembly 28 may be, for example, twelve inches in length. In each assembly 28, the shoe 38, the base member 32, the wedge member 36 and the cam lock lever 82 extend the full length of the assembly 28. However, other variations are possible. As one example, the assembly 28 can use one or more wedge members 36 and/or one or more levers 82, each shorter than the length of the assembly 28.

Figure 8:
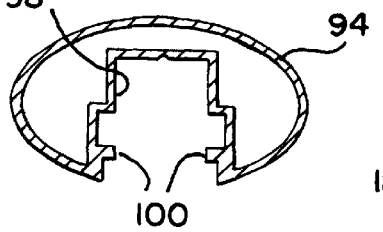
FIG. 8 is a vertical sectional view on an enlarged scale of the handrail of the railing assembly.
Figure 9:
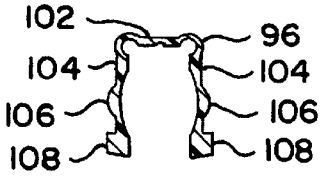
FIG. 9 is a vertical sectional view of the rail wedge member of the railing assembly.
Figure 10:
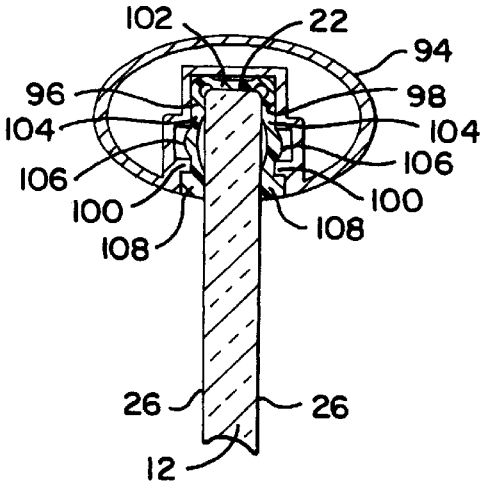
FIG. 10 is a vertical sectional view of the handrail assembly of the railing assembly.

Referring now to FIGS. 8–10, the handrail assembly 18 includes a rail 94 and a rail wedge member 96. Rail 94 defines a channel 98 having a relatively thinner base portion 98A and a relatively thicker portion 98B including a rib 100. The wedge member 96 includes a base portion 102 and a pair of leg portions 104 spaced apart by a distance approximately equal to or slightly larger than the thickness of the panel 12. A wedge shape is provided by a pair of enlarged portions 106 of the leg portions 104. A pair of flange portions 108 are formed at the ends of the leg portions 104. The rail 18 is preferable an extruded aluminum part, and the wedge member 96 is preferably an extrusion of a flexible plastic material such as vinyl.

To assemble the rail assembly, the rail wedge member 96 is placed upon the top edge 22 of the panel 12. The leg portions overlie the panels faces 26. Then the rail 94 is forced down onto the wedge member 96 assembled with the panel 12. The wedge member 96 seats in the channel 98 with the base portion 102 received in the thinner channel portion 98A and with the enlarged portions 106 received in the thicker portions 98B. The flange portions 108 are received against the ribs 100. A wedge action holds the rail assembly 18 securely on the panel 12.

While the present invention has been described with reference to the details of the embodiment of the invention shown in the drawing, these details are not intended to limit the scope of the invention as claimed in the appended claims.

What is claimed is:

1. A railing system including a railing support assembly for mounting a vertical glass panel above a floor surface, the panel having a peripheral edge and opposed planar side faces, said railing system comprising:

an elongated base;

an elongated support channel defined in said base;

said base including a pair of side walls and an end wall defining a generally U-shaped cross section of said channel, said channel having an open mouth;

a wedge member adapted to be mounted at a bottom edge of the panel, said wedge member having a base portion flanked by a pair of leg portions flexibly connected to said base portion, said leg portions defining a glass panel receiving pocket;

said channel having a tapered channel shape and said wedge member having a mating tapered wedge shape;

said open mouth of said channel being the widest part of said tapered channel shape;

said base portion of said wedge member being the narrowest part of said tapered wedge shape;

said wedge member being received into said channel, said leg portions of said wedge member contacting said side walls of said channel, said leg portions being flexed into said pocket by said side walls to provide a glass panel retention force;

a support shoe;

an attachment structure adapted to attach said support shoe to the floor surface; and a support structure securing said base to said support shoe;

said support structure including a first socket in said shoe and a first projection on said base received in said socket.

2. A railing system as claimed in claim 1 further comprising a second socket in said shoe and a second projection on said base received in said second socket.

3. A railing system as claimed in claim 2, further comprising a void in said second socket adjacent said second projection, and a lock member in said void preventing removal of said second projection from said second socket.

4. A railing system as claimed in claim 3 further comprising a cam lever, said lock member being defined at a first end of said lever, and the second end of said lever including a segment engageable with one of said wedge member leg portions.

5. A railing system as claimed in claim 1 wherein said tapered channel shape and said tapered wedge shape include surfaces inclined at a small angle.

* * * * *